US011260282B2

(12) United States Patent
Martinez

(10) Patent No.: US 11,260,282 B2
(45) Date of Patent: Mar. 1, 2022

(54) METHOD OF PLAYING SUDOKU USING A MAGNETIC SUDOKU BOARD WITH COLOR-CODED MAGNETS TO PROVIDE VISUAL ASSISTANCE

(71) Applicant: John A. Martinez, Minersville, UT (US)

(72) Inventor: John A. Martinez, Minersville, UT (US)

( * ) Notice: Subject to any disclaimer, the term of this patent is extended or adjusted under 35 U.S.C. 154(b) by 0 days.

(21) Appl. No.: 16/918,878

(22) Filed: Jul. 1, 2020

(65) Prior Publication Data

US 2021/0001208 A1 Jan. 7, 2021

Related U.S. Application Data

(60) Provisional application No. 62/871,029, filed on Jul. 5, 2019.

(51) Int. Cl.
*A63F 3/00* (2006.01)
*A63F 3/04* (2006.01)

(52) U.S. Cl.
CPC ..... *A63F 3/00694* (2013.01); *A63F 3/0023* (2013.01); *A63F 3/00574* (2013.01); *A63F 3/00697* (2013.01); *A63F 3/0415* (2013.01); *A63F 2003/0063* (2013.01); *A63F 2003/00239* (2013.01); *A63F 2003/00839* (2013.01); *A63F 2003/00876* (2013.01); *A63F 2003/0418* (2013.01)

(58) Field of Classification Search
CPC ..... A63F 3/00694; A63F 3/0415; A63F 3/00574; A63F 3/0023; A63F 3/00697; A63F 2003/00876; A63F 2003/0418; A63F 2003/0063; A63F 2003/00239; A63F 2003/00839
See application file for complete search history.

(56) References Cited

U.S. PATENT DOCUMENTS

| | | | | |
|---|---|---|---|---|
| 4,728,107 A * | 3/1988 | Dvorak | A63F 9/0803 | 273/273 |
| 5,478,085 A * | 12/1995 | Canner | A63F 3/00694 | 273/239 |
| 6,394,455 B1 * | 5/2002 | Denoual | A63F 3/00094 | 273/261 |
| 8,454,022 B1 * | 6/2013 | Zou | A63F 3/0415 | 273/283 |
| 2006/0138725 A1 * | 6/2006 | Zhitomirskaya | A63F 3/00694 | 273/239 |
| 2008/0054562 A1 * | 3/2008 | Kriger | A63F 3/0415 | 273/236 |
| 2012/0205868 A1 * | 8/2012 | Yahoodazadeh | A63F 3/0415 | 273/271 |

* cited by examiner

*Primary Examiner* — Michael D Dennis
(74) *Attorney, Agent, or Firm* — Gurr Brande & Spendlove, PLLC; Robert A. Gurr

(57) ABSTRACT

A magnetic sudoku board has a housing, a closeable lid and an inner playing surface. The inner playing surface having gridlines to form the magnetic sudoku board. An assortment of magnetic playing pieces includes a large set and small set. To distinguish between the numbers, 1-9, the assortment of magnetic playing pieces has a certain color that corresponds to a specific number. Accordingly, the same number in both the large set and the small set have coordinating colors. These colors visually assist the player so that the same numbers are not repeated in each column, row, and 3×3 grid box.

7 Claims, 5 Drawing Sheets

METHOD OF PLAYING SUDOKU USING A MAGNETIC SUDOKU BOARD WITH COLOR-CODED MAGNETS TO PROVIDE VISUAL ASSISTANCE

CROSS-REFERENCE TO RELATED APPLICATIONS

This application claims the benefit of U.S. Provisional Application Ser. No. 62/871,029, filed on Jul. 5, 2019, which is incorporated herein by reference.

TECHNICAL FIELD

The present disclosure relates to sudoku board games. More particularly, the present disclosure is directed to a method of playing sudoku using a self-contained magnetic sudoku board with various sized color-coded magnets to assist a player.

BACKGROUND sudoku has been around for years. This logic-based number placement puzzle can be found in the hands of the old and the young due to its popularity. sudoku consists of a 9×9 grid where each row, column, and 3×3 grid box must contain the numbers 1-9 without repeating. It can be a challenging and stimulating puzzle that focuses the mind and provides an escape from everyday activity. sudoku can also help the elderly with their memory and help the youth increase their logic skills. sudoku games are usually found in print, which can be a puzzle book, newspaper, or magazine. This form of the game is readily accessible to many age groups.

However, there are many downsides to playing sudoku on a printed form. It is inevitable that constant erasing will occur when using a printed sudoku puzzle. Accordingly, this leads to a messy, smudged playing surface that is hard to read, and can lead a user to frustration. Further, it is difficult for many individuals to hold a pencil and write, due to age, illness, or other disability. Further, the only way to verify accuracy is to tediously review each column and row for numbers. This can make it difficult to know whether you have used a certain number in a row, column, or 3×3 grid box, unless the numbers are continually checked. Once you have solved the sudoku puzzle on a paper form, it cannot be reused.

Other forms of the game can be found on various electronic devices, such as apps on handheld devices (e.g., phones, tablets) or sudoku handheld gaming devices. Electronic devices are convenient due to their availability. They also remove the burden of having to erase pencil marks after a mistake has been made. Even though electronic devices solve a lot of the issues that come from paper versions of the game, there are still downsides to using an electronic device. For example, the elderly may have a difficult time playing due to the limited size of a device screen and difficulty understanding and manipulating touchscreen technology. Additionally, a user must rely on number review alone to ensure correct placement. This leads the player to, again like the paper form, continually check for repeated numbers.

Accordingly, there is a need for a sudoku board that does not have to use a writing instrument, stays clean, can be repeatedly used, that is color-coded to assist the player, and does not require an electronic device. The present disclosure seeks to solve these and other problems.

SUMMARY OF EXAMPLE EMBODIMENTS

In one embodiment, a magnetic sudoku board comprises a housing, a closeable lid, and an inner playing surface. The inner playing surface comprises gridlines to form the magnetic sudoku board. A front side comprises the closeable lid that can open and close. In one embodiment, the closeable lid comprises a metal underplate positioned so as to hold and store magnetic playing pieces.

In one embodiment, the magnetic sudoku board comprises an assortment of magnetic playing pieces with a large set and a small set. Each playing piece is coupled to a magnet so that they magnetically couple to the metal underplate and an inner playing surface. The assortment of playing pieces, both the large set and small set, may be in various colors and have certain numbers, from 1-9, associated with a specific color.

In one embodiment, a sudoku puzzle book tells the player where certain numbers are located in the puzzle gridlines to assist the player. As the player finds these predetermined numbers from the sudoku puzzle book, the player places an indicator magnet in the designated number grid square. A large playing piece, with the designated number, is then placed in or over the indicator magnets. However, indicator magnets are not required, and a user may simply arrange the large playing pieces directly on the board when consulting the puzzle book.

In one embodiment, a magnetic sudoku board comprises an outer playing surface. The outer playing surface is recessed on a backside and is exposed. The outer playing surface can be used for many other games, such as checkers, chess, scrabble, etc.

In one embodiment, a magnetic sudoku board comprises two hinged doors, a first front hinge door and an opposite front hinge door. Both doors cover the entirety of the magnetic sudoku board. The two hinged doors comprise two metal door plates, a first metal door plate and a second metal door plate, that can act as a storage area for an assortment of magnetic playing pieces.

In one embodiment, a method of playing sudoku comprises determining the location of a predetermined assisting number from a sudoku puzzle book and placing an indicator magnet in the location. As the user begins the game, the user places the first set of small pieces in a certain row, column, or small 3×3 grid box to signal a possible answer. Only when a correct answer is known does the player place the second set of larger pieces, either by replacing the small piece or placing the large piece directly over the small piece. Then the player goes to the next move.

DETAILED DESCRIPTION OF EXAMPLE EMBODIMENTS

Figure 1:
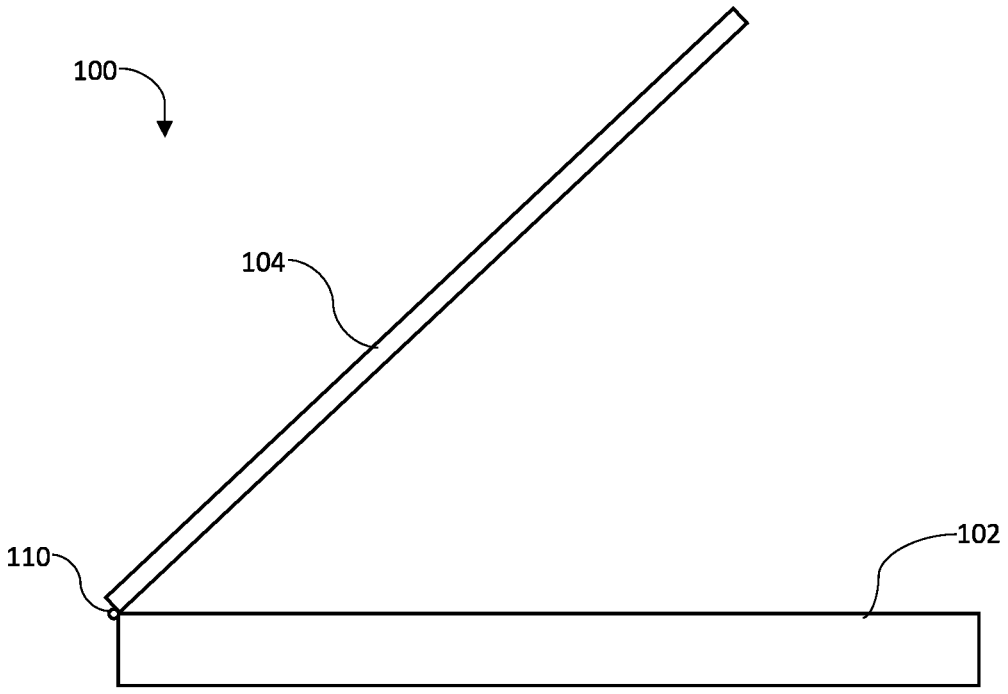
FIG. 1 is a side elevation view of a magnetic sudoku board with the closeable lid in an open position.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a sudoku board that does not have to use a writing instrument, stays clean, can be repeatedly used, that is color-coded to assist the player, and does not require an electronic device. The present disclosure seeks to solve these and other problems.

Sudoku is played by many people for entertainment, mental stimulation, and many other reasons. Generally, sudoku puzzles in the art are difficult for the elderly to use. Usually, these difficulties arise from the paper form of the game being small, making them difficult to see. Further, not only does the size of the typical sudoku puzzle pose difficulties for the elderly, but writing and constant erasing can be difficult for not only the elderly, but for other players. Individuals may have physical challenges that will not allow them to hold a writing instrument or even use a digital version of the game, leading to many individuals not being able to play sudoku to pass time or to keep their minds sharp.

In contrast, the magnetic sudoku board described herein comprises an assortment of magnetic playing pieces with a large set and a small set. The large set and small set aid children, elderly, and all other ages in completing a sudoku puzzle. The large set and the small set may be color-coded, or a specific shape/design, and numbered so that the small set will match the large set. To play sudoku using the magnetic sudoku board, a user would place a small piece on a square when the player is unsure of their move. When the user determines that move to be correct, the user would replace the small playing piece with a large playing piece of the same color or design (or couple the large piece to the small piece). The visual indication of the assortment of magnetic playing pieces may help a user more easily determine the position of each number from 1-9 due to the color or design. In fact, a user may not need to use the numbers on the assortment of playing pieces and may just use the nine different colors or shapes to determine each move on the board. Further, the assortment of playing pieces may further comprise beveled edges to assist children or the elderly in removing the pieces from the magnetic board. It will be appreciated that the magnetic sudoku board provides an easy way to play the game of sudoku for children, elderly, or others based on the magnetic playing pieces being visually distinct and having an accessible beveled edge.

Figure 2:
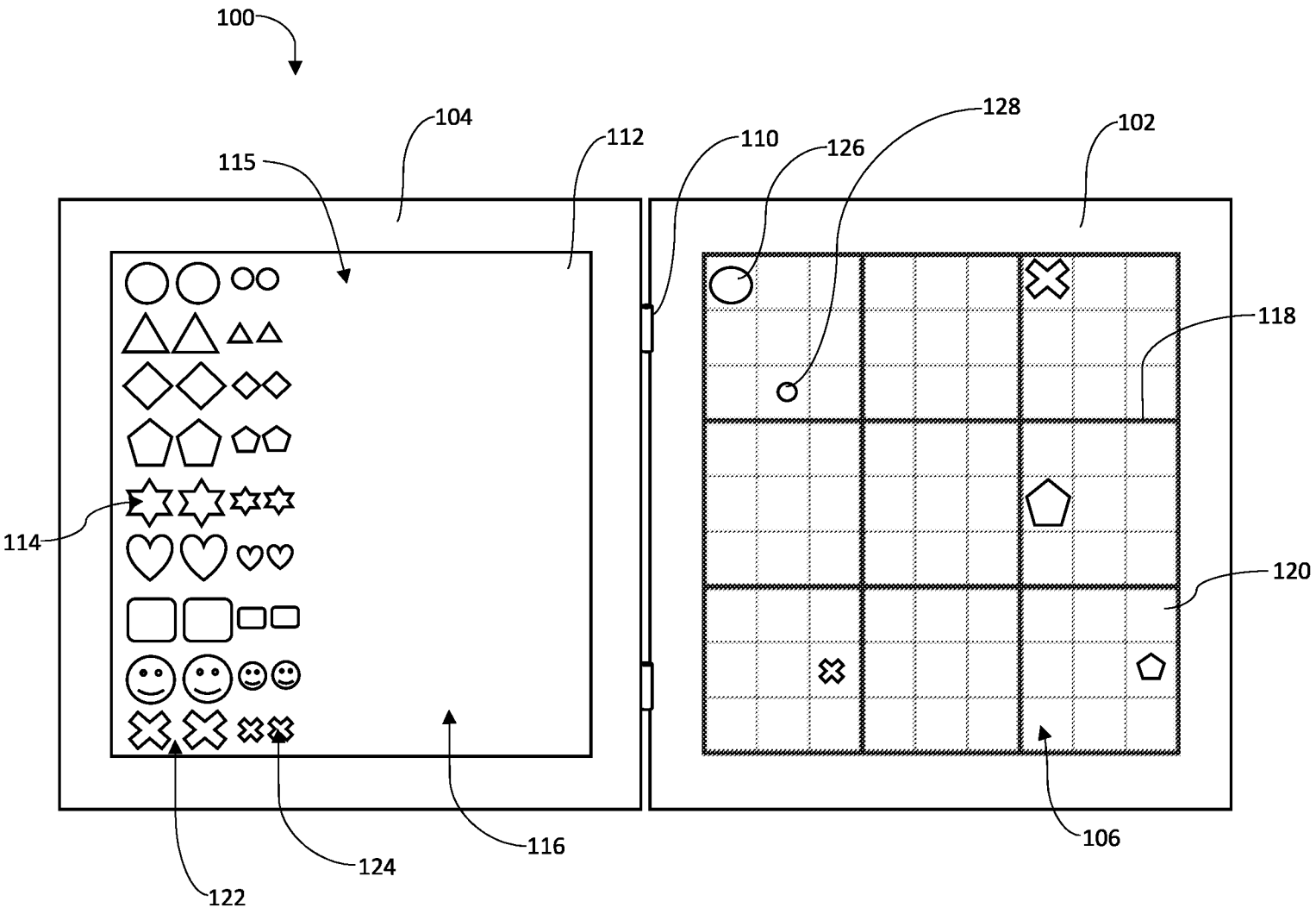
FIG. 2 is a top plan view of a magnetic sudoku board in an open position.

In one embodiment, as shown in FIGS. 1-2, a magnetic sudoku board 100 comprises a housing 102 and a closeable lid 104. When the closeable lid 104 is open (e.g., removed or pivoted on hinges), an inner playing surface 106 is exposed. In one embodiment, the closeable lid 104 is coupled to the housing 102 using a hinge 110. When the closeable lid 104 is closed, it encloses and covers the entirety of the inner playing surface 106 of the magnetic sudoku board 100. While a hinge 110 is used as an example, it will be appreciated that other mechanisms may be used, including, but not limited to, connected straps, a detached lid, etc. The closeable lid 104 comprises a metal underplate 112 positioned so as to hold and store an assortment of magnetic playing pieces 114 on an inner surface 115. The metal underplate 112 may be the desired storage 116 for the assortment of magnetic playing pieces 114; however, other forms of storage may be utilized, such as netting or a plastic container on the underside of the closeable lid 104.

It will be appreciated that the magnetic sudoku board 100 is a self-contained game due to the closeable lid 104. The assortment of playing pieces 114 can be magnetically coupled to either the inner playing surface 106 or the metal underplate 112, which creates a secure location for the assortment of playing pieces 114 and can prevent loss.

The inner playing surface 106 is held in a recessed position by the housing 102, which can be made of wood, metal, or any other suitable material. Furthermore, the inner playing surface 106 can be made of a ferromagnetic material, such as iron, nickel, or steel, so that any magnet can be magnetically coupled thereto. However, it will be appreciated that other surface materials may be used for the inner playing surface 106 (e.g., hook and loop or felt), with an assortment of playing pieces 114 that have a coupling device appropriate to the inner playing surface 106. To secure the inner playing surface 106 in a recessed position, many coupling mechanisms may be used, such as grooves cut on the inside of the housing 102 (e.g., tongue and groove coupling), or locking tabs or other protrusions protruding from the housing. The inner playing surface 106 can also comprise gridlines 118 to form the playing surface. Additionally, the gridlines 118 can be painted lines, magnetic strips, indentations in the metal, or any other means of forming gridlines 118. As the gridlines 118 are formed, the assortment of magnetic playing pieces 114 can be attached and detached in an individual grid square 120.

In one embodiment, the magnetic sudoku board comprises a magnetic playing surface without a housing. The magnetic playing surface may be stored in a traditional game board box, if desired. In another embodiment, the magnetic playing surface comprises a recessed underside for storage of the pieces thereon, with no box or housing required.

In one embodiment, the magnetic sudoku board 100 comprises an assortment of magnetic playing pieces 114 (best shown in FIG. 2) with a large set 122 and a small set 124. The large set 122 may comprise 81 pieces (not all shown in FIG. 2) so as to have a piece for each grid square 120. Additionally, the small set 124 may comprise up to 81 pieces. Each piece is coupled to a magnet so that they magnetically couple to the metal underplate 112 and the inner playing surface 106, which both can act as a storage area 116. The large set 122 and the small set 124 comprise individual pieces that can be square, rectangle, star shaped, circular, etc. To distinguish between the numbers 1-9 more easily, the assortment of magnetic playing pieces 114 (e.g., the large set 122 and small set 124) is given a certain color that corresponds to a specific number. For example, the number "1" pieces are all yellow, the number "2" pieces are all blue, etc. Further, the same number in both the large set 122 and the small set 124 have the same colors. Using colors allows a user to quickly identify correct placement of pieces without having to review each number. While colors may be a distinguishing characteristic between numbers, other distinguishing characteristics or designs may be used, such as printed graphics on the assortment of magnetic playing pieces 114 or different shapes, or some combination. In one embodiment, the assortment of magnetic playing pieces 114 may comprise the following numbers with their respective colors: #1 yellow; #2 sky blue; #3 white; #4 neon lime green; #5 dark blue; #6 orange; #7 red; #8 black; and #9 hot pink. The foregoing colors are used as examples only and are not to be considered limiting.

Various non-limiting examples of using colors, numbers, and shapes for the large and small sets are shown in the following tables:

TABLE 1

| Large Set | Small Set |
|---|---|
| #1 Yellow | #1 Yellow |
| #2 Sky Blue | #2 Sky Blue |
| #3 White | #3 White |
| #4 Neon Lime | #4 Neon Lime |
| #5 Dark Blue | #5 Dark Blue |
| #6 Orange | #6 Orange |
| #7 Red | #7 Red |
| #8 Black | #8 Black |
| #9 Hot Pink | #9 Hot Pink |

TABLE 2

| Large Set | Small Set |
|---|---|
| Circle | Circle |
| Triangle | Triangle |
| Diamond | Diamond |
| Pentagon | Pentagon |
| Star | Star |

TABLE 2-continued

| Large Set | Small Set |
|---|---|
| Heart | Heart |
| Square | Square |
| Smiley Face | Smiley Face |
| X | X |

TABLE 3

| Large Set | Small Set |
|---|---|
| #1 Circle | #1 Circle |
| #2 Triangle | #2 Triangle |
| #3 Diamond | #3 Diamond |
| #4 Pentagon | #4 Pentagon |
| #5 Star | #5 Star |
| #6 Heart | #6 Heart |
| #7 Square | #7 Square |
| #8 Smiley Face | #8 Smiley Face |
| #9 X | #9 X |

TABLE 4

| Large Set | Small Set |
|---|---|
| #1 Yellow Circle | #1 Yellow Circle |
| #2 Sky Blue Triangle | #2 Sky Blue Triangle |
| #3 White Diamond | #3 White Diamond |
| #4 Neon Lime Pentagon | #4 Neon Lime Pentagon |
| #5 Dark Blue Star | #5 Dark Blue Star |
| #6 Orange Heart | #6 Orange Heart |
| #7 Red Square | #7 Red Square |
| #8 Black Smiley Face | #8 Black Smiley Face |
| #9 Hot Pink X | #9 Hot Pink X |

Because each number has a corresponding shape or color, a user may very easily determine if the same number has been used more than once in any given row or column by simply looking for repeated shapes or colors, rather than focusing on individual numbers. Because shapes and colors are easier to identify, children and the elderly can more easily find and determine playing mistakes. It also helps individuals play who may otherwise lack the mental cognizance required to play traditional sudoku which requires the player to study numbers. It will be appreciated that the assortment of playing pieces 114, with their different shapes or colors, is a vast improvement over the prior art when it comes to assisting the player in visualizing the correct puzzle formation.

Figure 3:
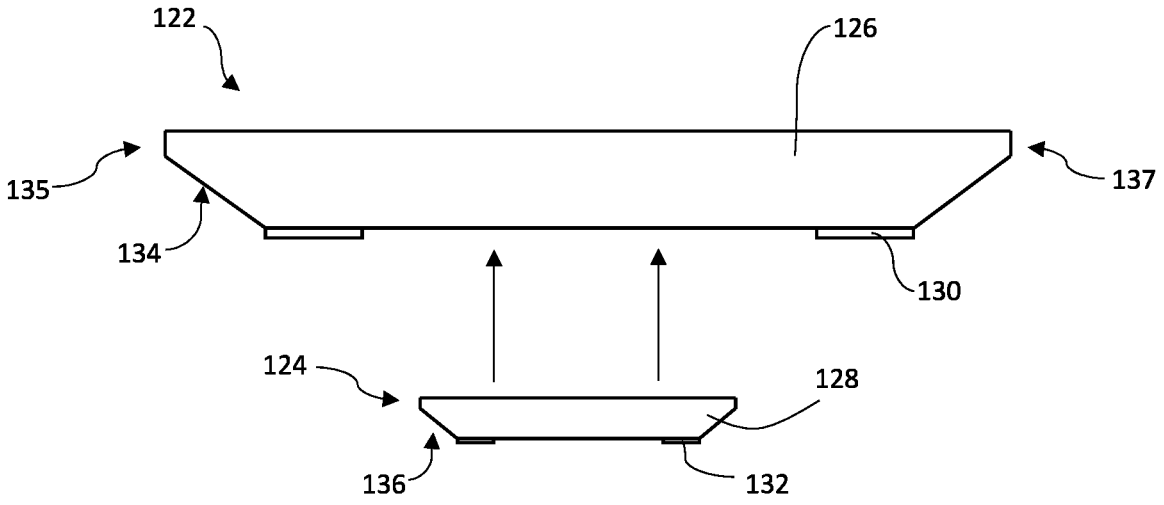
FIG. 3 is a side elevation view of a large and a small playing piece of a magnetic sudoku board.
Figure 4:
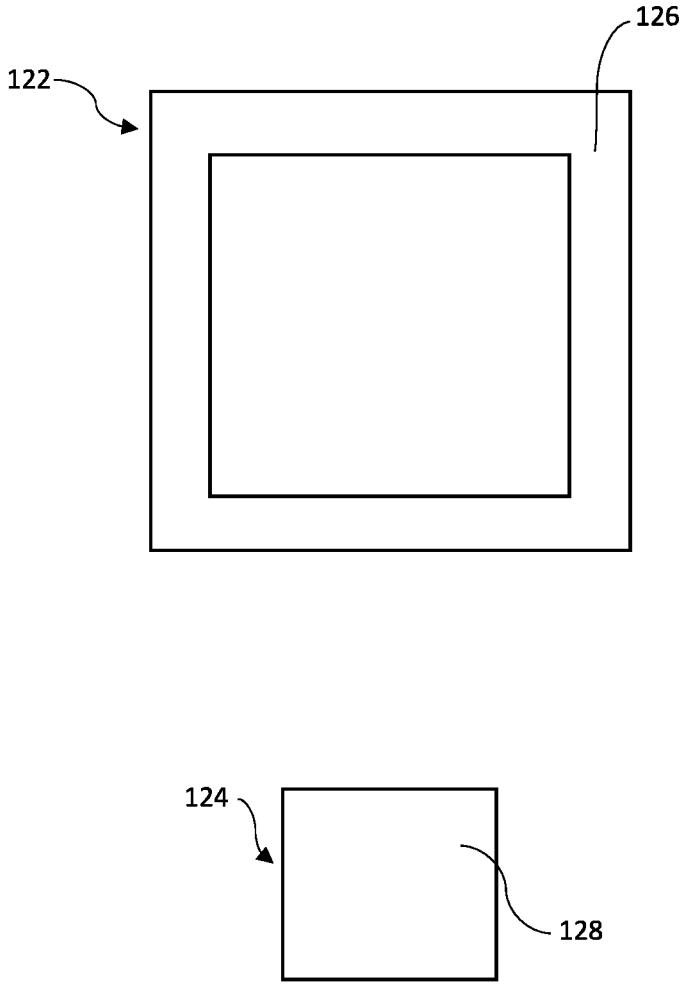
FIG. 4 is a top plan view of a large and a small playing piece of a magnetic sudoku board.

As shown in FIG. 3-4, the large set 122 may comprise large pieces 126 and the small set 124 may comprise small pieces 128. The large pieces 126 and the small pieces 128 may comprise magnets 130, 132 so as to be coupleable to the sudoku board 100. The magnets 130, 132 may be strips, circles, etc. Further, the large and small pieces 126, 128 may comprise finger lifts 134, 136 (e.g., beveled edges). It will be appreciated that the finger lifts 134, 136 may assist a child or the elderly when a piece needs to be removed. For example, a player may remove a playing piece by pressing downward on a first side 135, which raises an opposite, second side 137 from the board for grasping. Additionally, as shown, the small pieces are sized so as to be nestable with the large pieces 126. This allows a player to place a small piece 128 when contemplating a position on the puzzle and, when the placement is confirmed, place the large piece 126 directly over the small piece 128, receiving (e.g., nesting) the small piece 128 therein.

In one embodiment, the magnetic sudoku board comprises indicator magnets placed within certain grid squares. The indicator magnets are smaller than the size of the grid square so that they fit properly within a grid square. The indicator magnets are shown as white squares, but they can come in other colors and shapes (e.g., a blue star). In addition, the indicator magnets can have an aperture to receive the bases of the large set. A sudoku puzzle book tells the player where certain numbers are located in the puzzle gridlines to assist the player. As the player finds these predetermined numbers from the sudoku puzzle book, the player places the indicator magnet in the designated number grid square. A large piece 126, with the designated number, is then placed in or over the indicator magnet. In an alternative embodiment, indicator magnets are not required, and user may place a large piece 126 directly on the board.

It will be understood that the magnetic sudoku board 100 is used in conjunction with a sudoku puzzle book, whether in a printed form or digital. It will be appreciated that the magnetic sudoku board 100 solves many issues in the prior art because it can be reused numerous times, while other sudoku boards can only be used once. The magnetic sudoku board 100 can also come in a variety of sizes, including, but not limited to, compact travel sizes or large sizes for the elderly. In addition, there are not messes or smudges when using magnets in a small or large sized game, which are generally found on paper forms of the puzzle. Often, elderly individuals lack the dexterity required for both traditional sudoku and electronic sudoku. Accordingly, it will be appreciated that the use of physical pieces reduces the need for dexterity and allows the player to easily move the pieces from location to location. Further, colored pieces allow for users to more easily determine when a piece has been properly placed or not, removing the need to tediously review the numbers in each square.

In one embodiment, a magnetic sudoku board comprises an outer playing surface. The outer playing surface is recessed on a backside and may remain exposed. The outer playing surface can be used for many games, such as checkers, chess, scrabble, etc.

In one embodiment, a method of playing sudoku comprises using a sudoku puzzle book to initiate a game. The player then places a small piece 128 in a certain row, column, or small 3×3 grid box to signal a possible answer. Only when a correct answer is known does the player place a large piece 126. Then the player goes to the next move.

Figure 5:
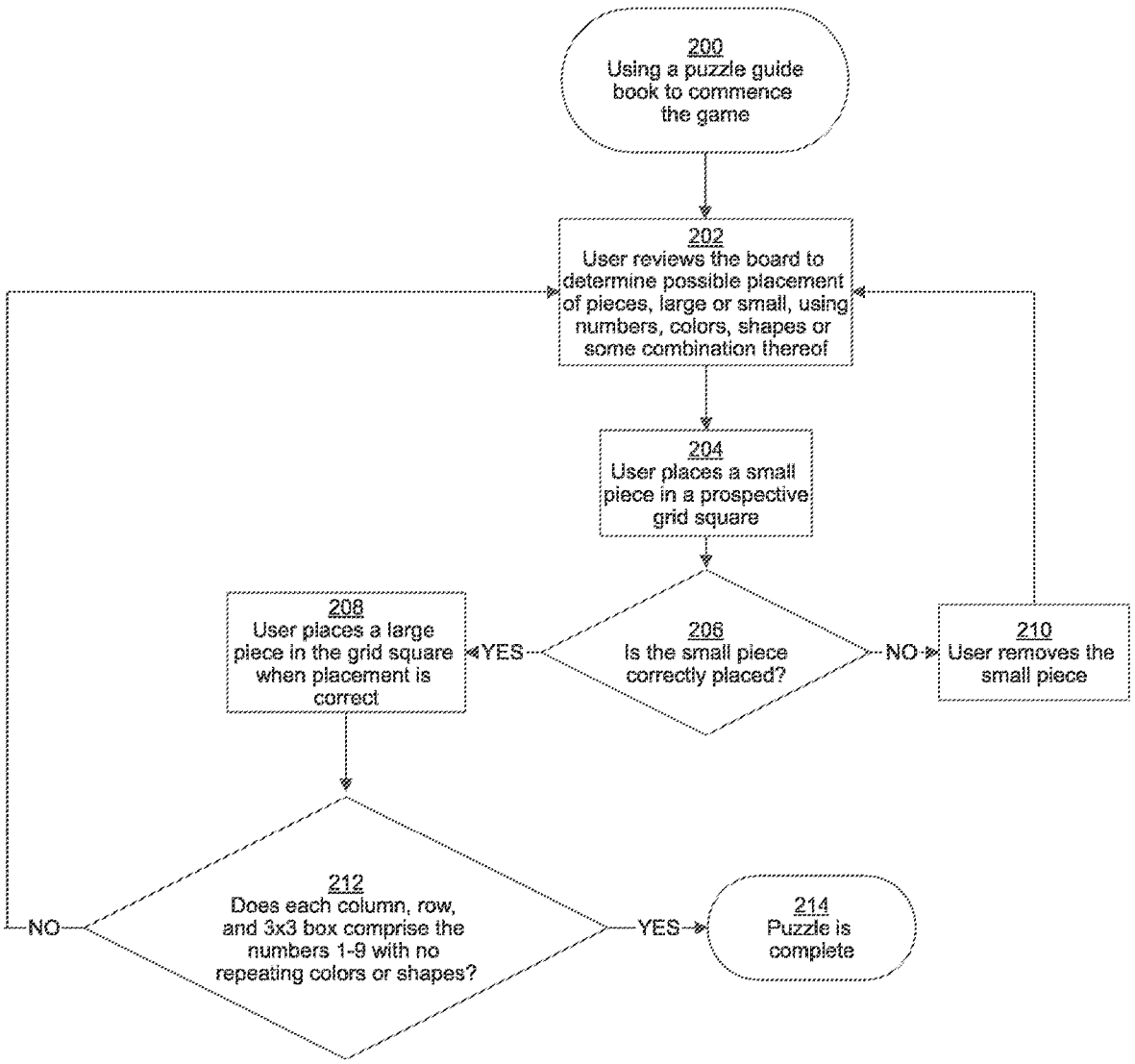
FIG. 5 is a flowchart for a method of playing sudoku.

More specifically and as shown in FIG. 5, a method of playing sudoku comprises the following steps: at step 200, using a puzzle guide book to commence the game; at step 202, the user reviews the board to determine possible placement of pieces, large or small, using numbers, colors, shapes or some combination thereof; at step 204, the user places a small piece 128 in a prospective grid square; at step 206, is the small piece 128 correctly placed?; if placement is correct, at step 208, user places a large piece 126 in the grid square; if placement is incorrect, at step 210, user removes the small piece and returns to step 202; referring to step 212, does each column, row, and 3×3 box comprise the number 1-9 with no repeating colors or shapes?; if yes, at step 214, puzzle is complete; if no, the user returns to step 202. Because colors and/or shapes are used in addition to colors, a user is able to more easily determine when pieces have been properly placed and the game correctly completed. Using colored pieces overcomes the prior art significantly, which typically requires erasures, digital boards, and a tedious study of numbers.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A method of playing sudoku, comprising:

using:

i. nine sets of large playing pieces, each set comprising nine large playing pieces having a first size and labeled one through nine with each number corresponding to a unique color, and ii. nine sets of small playing pieces, each set comprising nine small playing pieces having a second size smaller than the first size of the large playing pieces, and labeled one through nine with each number corresponding to the unique colors of the large playing pieces;

determining an initial game layout and placing one or more large playing pieces in corresponding positions to the initial game layout on a sudoku board;

placing one or more small playing pieces on the board to signify a possible solution;

when a solution is confirmed, placing each large playing piece over each small playing piece of a corresponding number and color, each large playing piece comprising an aperture on an underside configured to receive each small playing piece.

2. The method of claim 1, wherein each small piece has a unique shape, the player identifying solutions using the number, color, or shape.

3. The method of claim 2, wherein each large piece has a unique shape, the player identifying solutions using the number, color, or shape.

4. The method of claim 1, wherein each piece is magnetic and the player magnetically couples each small piece and each large piece to the board magnetically.

5. A method of playing sudoku, comprising:

determining an initial layout of sudoku;

using a sudoku board, the sudoku board comprising:

a housing comprising an inner playing surface with a plurality of grid squares, a closeable lid to cover the inner playing surface, a metal underplate coupled to an inner surface of the closeable lid to store a plurality of playing pieces, the plurality of playing pieces comprising:

nine sets of large playing pieces having a first size, each set comprising playing pieces labeled one through nine, and nine sets of small playing pieces having a second size smaller than the first size, each set comprising playing pieces labeled one through nine, wherein each large playing piece and each small playing piece comprise a color corresponding to the labeled number on each playing piece, respectively, each large playing piece comprising an aperture centered on an underside configured to receive each small playing piece of the same color and number, each of the large playing pieces and the small playing pieces comprising finger lifts formed from a top edge tapering inward to a bottom edge, and each of the large playing pieces and the small playing pieces comprising at least one magnet;

placing a small playing piece in a grid square of the plurality of grid squares on the inner playing surface to signal a potential solution;

when a solution is determined, placing a large playing piece of the same color and number as the small playing piece over the small playing piece, the small playing piece being received within the aperture of the large playing piece; and determining a completed 3×3 box, column, and row by confirming there are no repeated numbers or colors.

6. The method of claim 5, wherein the closeable lid is hingedly coupleable to the housing, the player opening the closeable lid to expose the inner playing surface.

7. The method of claim 5, wherein the player may remove each small playing piece or large playing piece by pressing downward on a first side, which raises an opposite, second side from the board for grasping.

* * * * *